US007896706B1

(12) United States Patent
Peng et al.

(10) Patent No.: US 7,896,706 B1
(45) Date of Patent: Mar. 1, 2011

(54) AUDIO JACK CONNECTOR

(75) Inventors: Yung-Chi Peng, Tu-Cheng (TW); Sheng-Nan Yu, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/633,785

(22) Filed: Dec. 8, 2009

(51) Int. Cl.
*H01R 24/04* (2006.01)

(52) U.S. Cl. ..... 439/668

(58) Field of Classification Search ..... 439/668, 439/669, 188
See application file for complete search history.

(56) References Cited

U.S. PATENT DOCUMENTS

| | | | | |
|---|---|---|---|---|
| 6,227,905 | B1 * | 5/2001 | Tsai et al. | 439/541.5 |
| 6,382,999 | B1 * | 5/2002 | Mou et al. | 439/188 |
| 7,033,226 | B1 * | 4/2006 | Chien et al. | 439/668 |
| 7,128,591 | B2 * | 10/2006 | Tsai | 439/188 |
| 7,137,851 | B2 * | 11/2006 | Xue et al. | 439/668 |
| 7,147,497 | B1 * | 12/2006 | Liao et al. | 439/188 |
| 7,150,641 | B2 * | 12/2006 | Tsai | 439/188 |
| 7,331,825 | B2 * | 2/2008 | Xue et al. | 439/668 |
| 7,351,113 | B2 * | 4/2008 | Lee et al. | 439/668 |
| 7,361,062 | B2 * | 4/2008 | Long et al. | 439/668 |
| 7,371,125 | B2 * | 5/2008 | McHugh et al. | 439/668 |
| 7,566,242 | B2 * | 7/2009 | Zhu et al. | 439/567 |
| 7,568,929 | B1 * | 8/2009 | Su et al. | 439/188 |
| 7,682,173 | B2 * | 3/2010 | Zhu et al. | 439/188 |
| 7,753,738 | B2 * | 7/2010 | Zhang | 439/668 |
| 2005/0095908 | A1 * | 5/2005 | Xue et al. | 439/541.5 |
| 2007/0066145 | A1 * | 3/2007 | Xue et al. | 439/668 |
| 2007/0149062 | A1 * | 6/2007 | Long et al. | 439/668 |
| 2008/0050977 | A1 * | 2/2008 | Lee et al. | 439/668 |
| 2009/0011629 | A1 * | 1/2009 | Wang et al. | 439/188 |
| 2009/0149080 | A1 * | 6/2009 | Wu | 439/668 |
| 2009/0176414 | A1 * | 7/2009 | Chien et al. | 439/668 |

* cited by examiner

*Primary Examiner*—T C Patel
*Assistant Examiner*—Vladimir Imas
(74) *Attorney, Agent, or Firm*—Cheng-Ju Chiang

(57) ABSTRACT

An audio jack connector has an insulating housing. The insulating housing has a passageway extended from a front surface towards a rear surface thereof for receiving an audio plug connector, a first groove communicated with the passageway and a second groove communicated with the first groove. A first switch terminal received in the first groove has a base plate, an elastic arm extended from one end of the base plate and bent towards the passageway, and a first contacting portion formed at a free end of the elastic arm. A first convexity is formed at a substantially root portion of the elastic arm. A second switch terminal received in the second groove has a second contacting portion. The first contacting portion is driven to move outwards to contact with the second contacting portion when the audio plug connector is inserted in the passageway and resists against the first convexity outwards.

5 Claims, 6 Drawing Sheets

AUDIO JACK CONNECTOR

BACKGROUND OF THE INVENTION

1. Field of the Invention

The present invention relates to an electrical connector, and more particularly to an audio jack connector capable of transmitting audio signals.

2. The Related Art

An audio jack connector mounted to an electronic device has an insulating housing, a first switch terminal and a second switch terminal. The insulating housing has a passageway passing therethrough for receiving an audio plug connector, a first groove and a second groove communicating with the passageway. The first switch terminal and the second switch terminal are received in the first groove and the second groove, respectively, and at one side of the passageway. The first switch terminal has an elastic portion of arch shape projecting into the passageway, and a first contacting portion connected with a free end of the elastic portion. The second switch terminal has a second contacting portion facing to the first contacting portion and spaced away from each other. When the audio plug connector is inserted into the passageway, the elastic portion is pressed by the audio plug connector to make the first contacting portion contact the second contacting portion, which forms electrical connection between the switch terminals. However, the first contacting portion of the conventional audio jack connector usually moves in a small range when the audio plug connector is against the elastic portion. This will make the connection and separation of the switch terminals unreliable, in other words, working performance of the audio jack connector may be influenced.

SUMMARY OF THE INVENTION

Accordingly, an object of the present invention is to provide an audio jack connector for receiving an audio plug connector. The audio jack connector has an insulating housing. The insulating housing has a passageway extended from a front surface towards a rear surface thereof for receiving the audio plug connector, a first groove communicated with the passageway and a second groove communicated with the first groove. A first switch terminal received in the first groove has a base plate, an elastic arm extended from one end of the base plate and bent towards the passageway, and a first contacting portion formed at a free end of the elastic arm. A first convexity is protruded into the passageway from a substantially root portion of the elastic arm. A second switch terminal received in the second groove has a second contacting portion spaced from the first contacting portion. The first contacting portion is driven to move outwards to contact with the second contacting portion when the audio plug connector is inserted in the passageway and resists against the first convexity outwards.

As described above, when the audio plug connector is inserted into the passageway and resists against the first convexity outwards, the first contacting portion can be driven to move in a much wider range to contact the second contacting portion. So the connection and separation between the first switch terminal and the second switch terminal will be more reliable, and the working performance of the audio jack connector will be good and steady.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
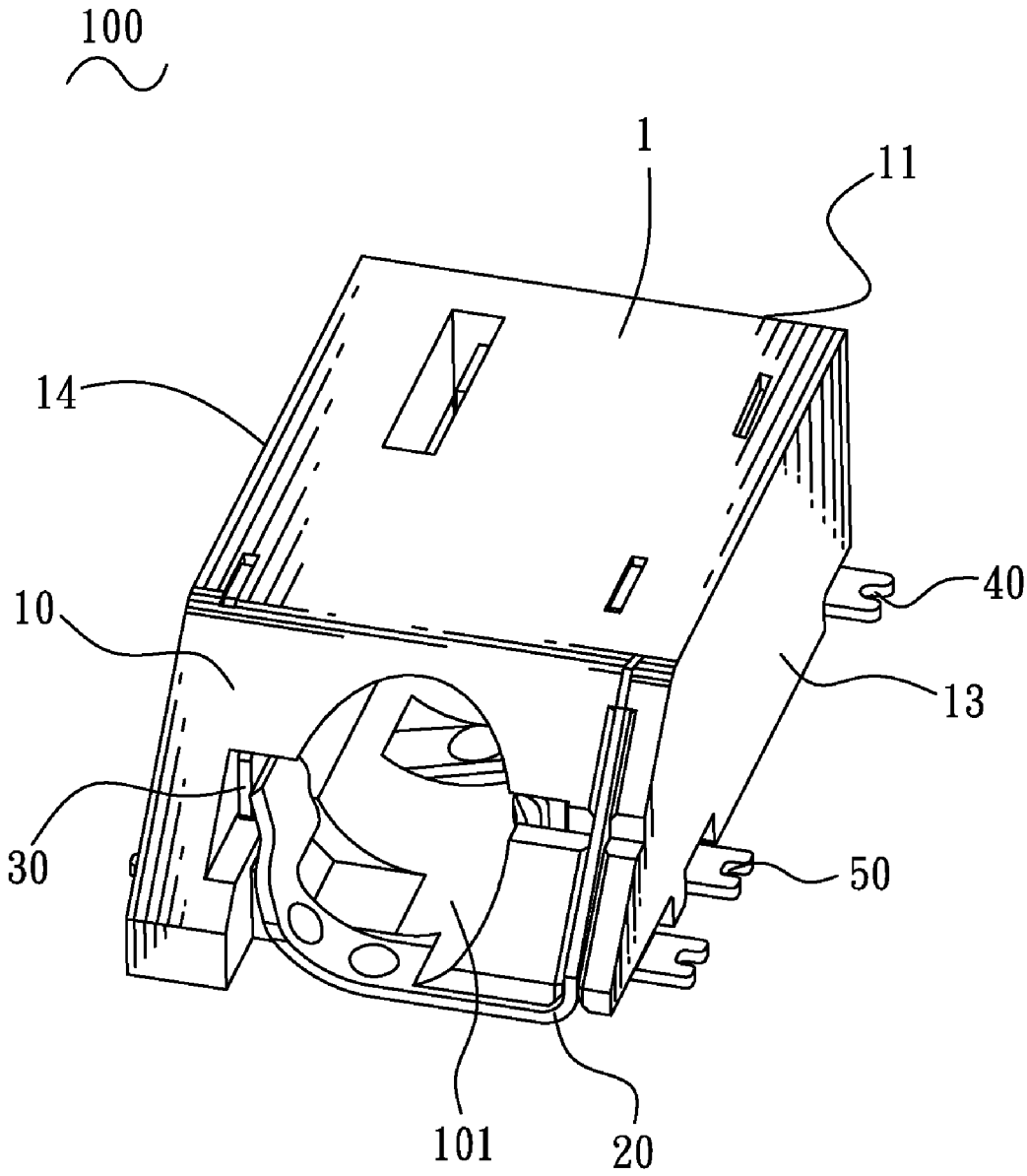
FIG. 1 is an assembled, perspective view of an audio jack connector of an embodiment in accordance with the present invention.
Figure 2:
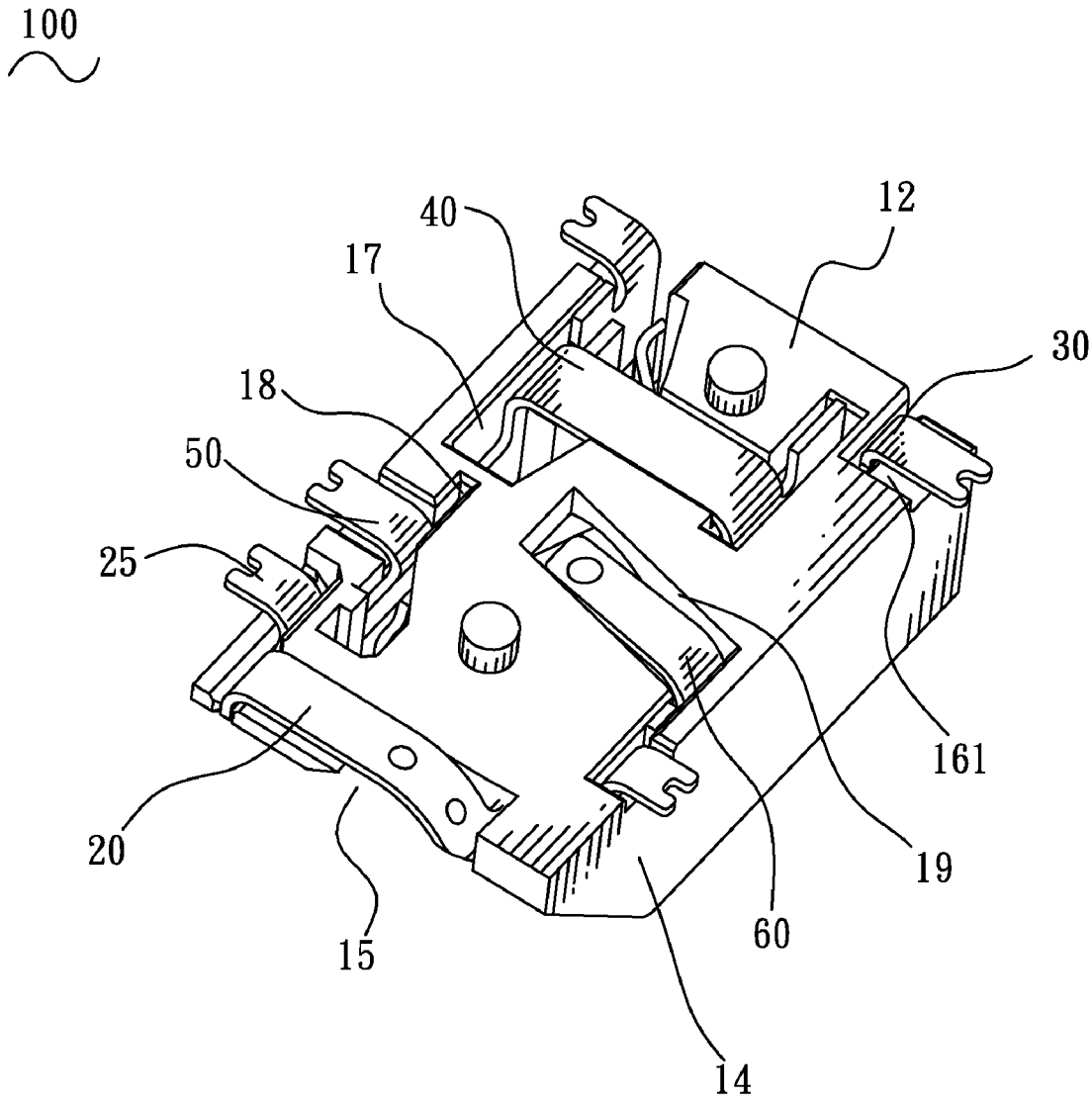
FIG. 2 is an assembled, perspective view of the audio jack connector shown in FIG. 1 seen from a bottom direction.
Figure 3:
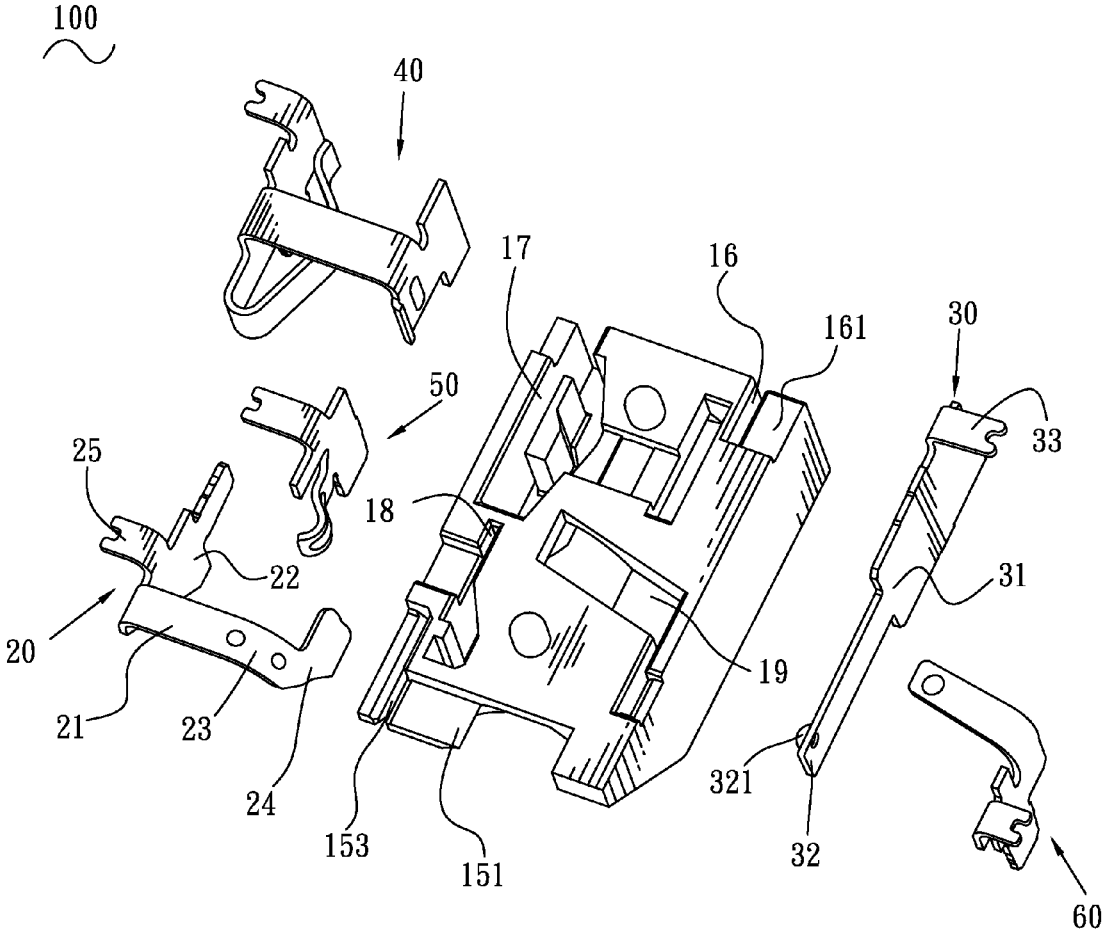
FIG. 3 is an exploded, perspective view of the audio jack connector shown in FIG. 2.
Figure 4:
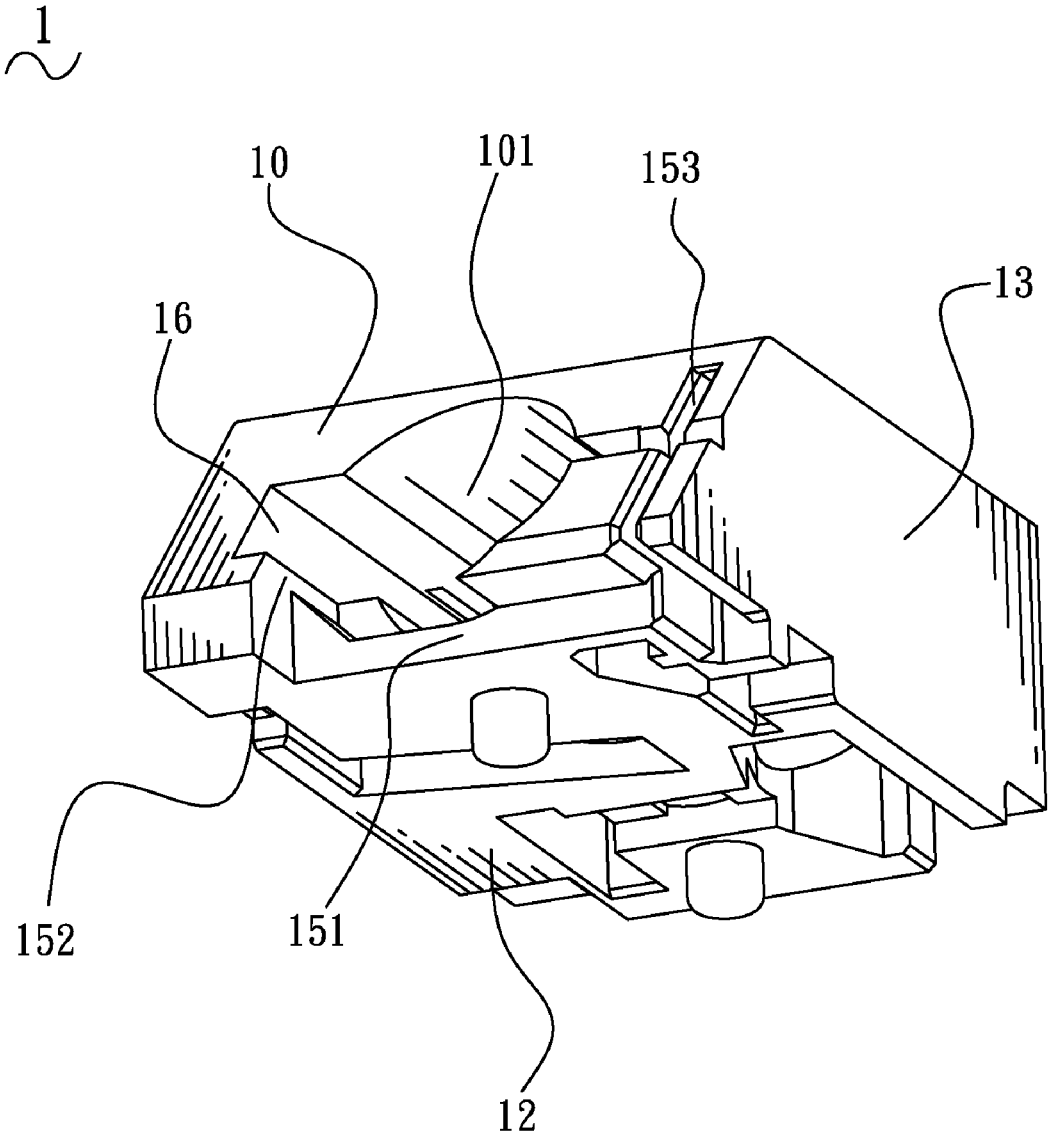
FIG. 4 is a perspective view of an insulating housing of the audio jack connector shown in FIG. 1 seen from another direction.
Figure 5:
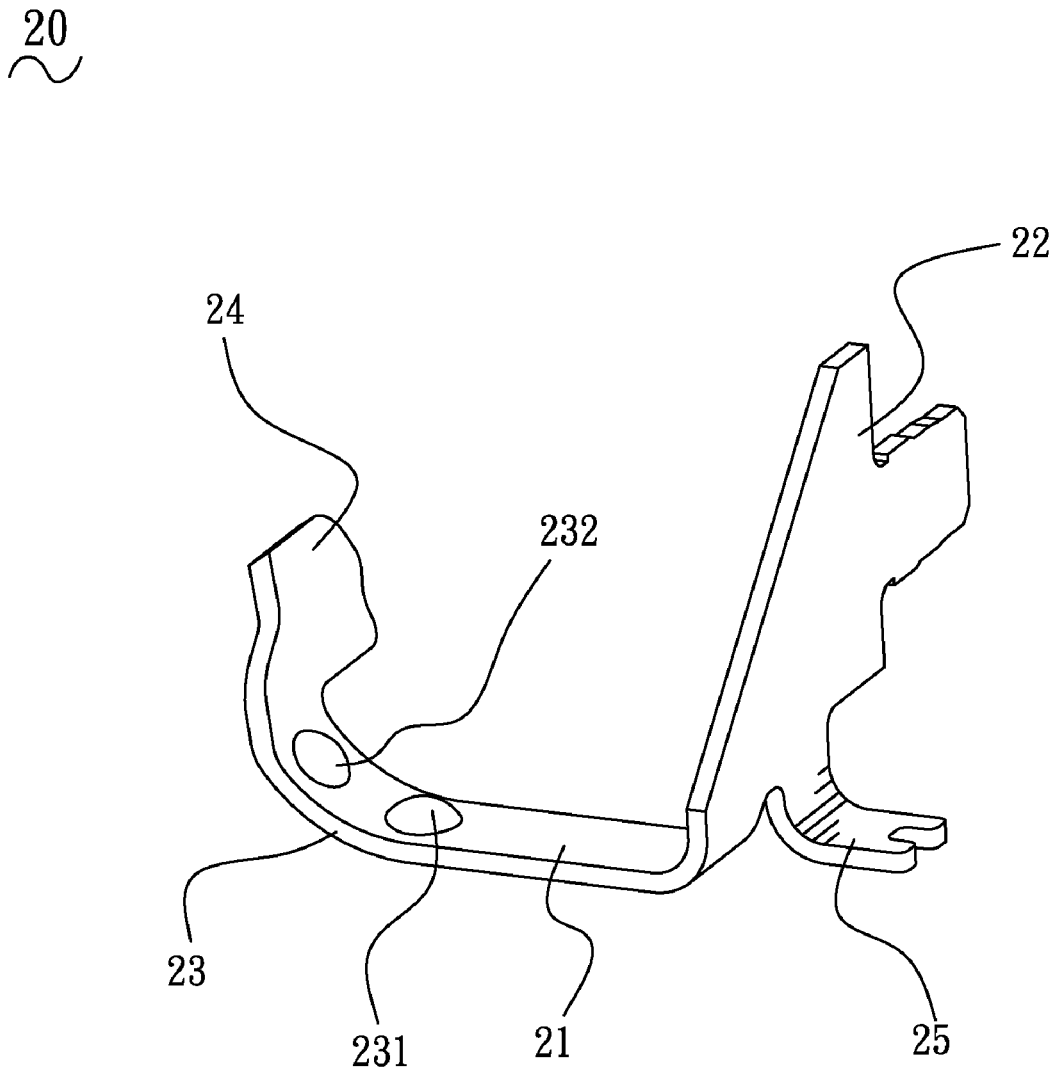
FIG. 5 is a perspective view of a first switch terminal of the audio jack shown in FIG. 1.
Figure 6:
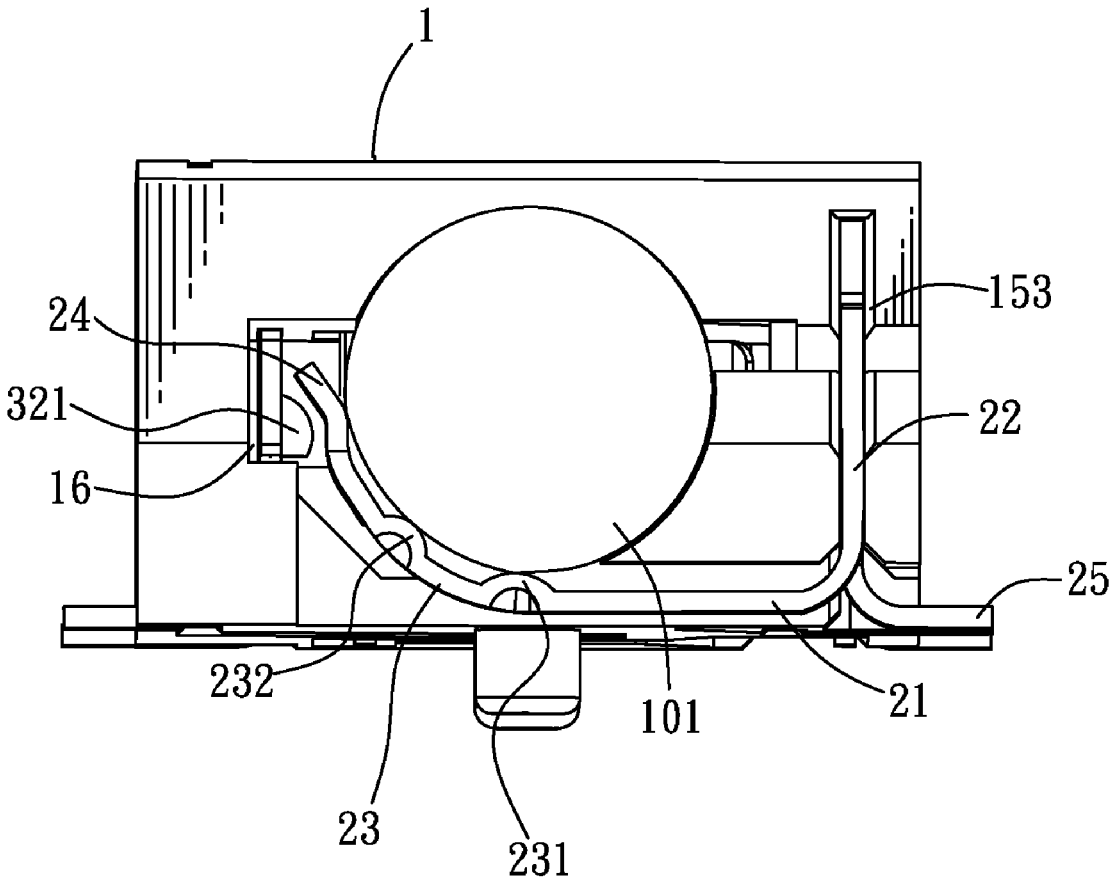
FIG. 6 is plan view of the audio jack connector shown in FIG. 1.

Referring to FIG. 1 and FIG. 2, an audio jack connector 100 according to the present invention is shown. The audio jack 100 has an insulating housing 1, a first transmitting terminal 40, a second transmitting terminal 50, a third transmitting terminal 60 and a group of switch terminals, which are all mounted to the insulating housing 1. The switch terminals include a first switch terminal 20 and a second switch terminal 30.

With reference to FIGS. 1-4, the insulating housing 1 is a substantially rectangular shape and has an inclined front surface 10, a rear surface 11 opposite to the front surface 10, a bottom surface 12, a first lateral surface 13 and a second lateral surface 14 opposite to the first lateral surface 13. A passageway 101, with a round cross-section, is formed in the insulating housing 1 and passes through the middle portions of the front surface 10 and the rear surface 11 for receiving a mating audio plug connector (not shown). The insulating housing 1 has a first groove 15, a second groove 16, a third groove 17, a fourth groove 18 and a fifth groove 19, all communicating with the passageway 101, and for receiving the first switch terminal 20, the second switch terminal 30, the first transmitting terminal 40, the second transmitting terminal 50 and the third transmitting terminal 60, respectively.

The first groove 15 has a bottom slot 151 at a front end of the bottom surface 12, passing through the front surface 10 and the first lateral surface 13, and a receiving recess 152 at a front surface 10 perpendicularly connected to one end the bottom slot 151 adjacent to the second lateral surface 14 and communicating with the passageway 101. The front surface 10 has a fixing slot 153 which is disposed at one side of the passageway 101 adjacent to the first lateral surface 13. The fixing slot 153 extends rearwards a distance along the first lateral surface 13, with a bottom end substantially perpendicularly connected to the other end of the bottom slot 151. The second groove 16 is arranged at the other side of the passageway 101 adjacent to the second lateral surface 14 and opposite to the fixing slot 153, and extends along a front and rear direction to penetrate the front surface 10 and the rear surface 11, with a front end thereof communicating with the receiving recess 152. A rear end of the bottom surface 12 is formed with a notch 161 located under the second groove 16. The notch 161 passes through the second lateral surface 14 and the rear surface 11 of the insulating housing 1, communicating with the second groove 16.

With reference to FIGS. 2-5, the first switch terminal 20 received in the first groove 15 has a base plate 21 located in the bottom slot 151. One end of the base plate 21 is extended upwards perpendicular to the base plate 21 and elongated rearwards to form a substantial triangle fixing plate 22 received in the fixing slot 153. An elastic arm 23 received in the receiving recess 152 is extended from the other end of the base plate 21 and bent towards the passageway 101. The elastic arm 23 has a first convexity 231, which is protruded into the passageway 101 from a substantial root portion of the elastic arm 23, and a second convexity 232, which is protruded into the passageway 101 from a middle of the elastic arm 23 and spaced away from the first convexity 231. A free end of the elastic arm 23 is extended upwards and rearwards and arched oppositely to the fixing plate 22 to form a first contacting portion 24, facing to the fixing plate 22, with a free end thereof projecting into the second groove 16. A first soldering strip 25 is extended oppositely to the base plate 21 from a bottom edge of the fixing plate 22 rear of the base plate 21, stretching out of the insulating housing 1 from a rear of the bottom end of the fixing slot 153. The second switch terminal 30 is inserted into the second groove 16 from a rear direction and has a fixing strip 31 and a second contacting portion 32. The second contacting portion 32 is extended frontward from a middle portion of a front edge of the fixing strip 31. A side of the second contacting portion 32 has a third convexity 321 protruded towards the passageway 101 from a front end thereof, facing to the first contacting portion 24 of the first switch terminal 20 and spaced away from each other. A rear end of a top edge of the fixing strip 31 is extended oppositely to the third convexity 321 to form a second soldering strip 33, located in the notch 161 and exposed out of the insulating housing 1.

With reference to FIGS. 1-6, when the audio plug connector is inserted into the passageway 101 and resists against the first convexity 231 and the second convexity 232 of the first switch terminal 20 to make the elastic arm 23 move outwards along a direction of the pressure, the first contacting portion 24 is driven to contact the third convexity 321 by the elastic arm 23, which forms electrical connection between the first switch terminal 20 and the second switch terminal 30.

As described above, when the audio plug connector is inserted into the passageway 101 and resists against the first convexity 231 and the second convexity 232 outwards, the first contacting portion 24 can be driven to move in a much wider range to contact the third convexity 321 of the second contacting portion 32. So the connection and separation between the first switch terminal 20 and the second switch terminal 30 will be more reliable, and the working performance of the audio jack connector 100 will be good and steady.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio jack connector for receiving an audio plug connector, comprising:

an insulating housing having a passageway extending from a front surface thereof towards a rear surface thereof for receiving the audio plug connector, a first groove communicating with the passageway, and a second groove communicating with the first groove, the first groove including a bottom slot defined at the front surface, and a receiving recess formed at the front surface and communicating with the passageway, two opposite ends of the receiving recess connecting with the second groove and one end of the bottom slot, a fixing slot defined at the front surface, with a bottom end substantially perpendicularly connected to the other end of the bottom slot;

a first switch terminal received in the first groove, the first switch terminal having a base plate, an elastic arm extending from one end of the base plate and bent towards the passageway, a first contacting portion formed at a free end of the elastic arm, a first convexity protruded into the passageway from a substantially root portion of the elastic arm, the first switch terminal further comprising a fixing plate being substantially perpendicularly to the base plate, with a bottom connected with the other end of the base plate, received in the fixing slot; and a second switch terminal received in the second groove, the second switch terminal having a second contacting portion spaced from the first contacting portion;

wherein the first contacting portion is driven to move outwards to contact the second contacting portion when the audio plug connector is inserted in the passageway and resists against the first convexity outwards, the base plate is received in the bottom slot, and the elastic arm and the first contacting portion are received in the receiving recess.

2. The audio jack connector as claimed in claim 1, wherein a middle portion of the elastic arm is protruded into the passageway to form a second convexity spaced away from the first convexity.

3. The audio jack connector as claimed in claim 1, wherein the elastic arm is arc shape.

4. The audio jack connector as claimed in claim 1, wherein a portion of the second contacting portion is protruded towards the first contacting portion to form a third convexity for contacting with the first contacting portion.

5. The audio jack connector as claimed in claim 1, wherein the bottom of the fixing plate is connected with the base plate by a front thereof and further extends opposite to the base plate to form a first soldering portion rear of the base plate.

* * * * *